US008398079B2

(12) United States Patent
Ootsuka

(10) Patent No.: US 8,398,079 B2
(45) Date of Patent: Mar. 19, 2013

(54) IMAGE FORMING APPARATUS

(75) Inventor: Yuuya Ootsuka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/433,498

(22) Filed: Mar. 29, 2012

(65) Prior Publication Data

US 2012/0267847 A1 Oct. 25, 2012

(30) Foreign Application Priority Data

Apr. 22, 2011 (JP) ..... 2011-095656

(51) Int. Cl.
*B65H 9/00* (2006.01)

(52) U.S. Cl. ..... 271/236; 271/239; 271/234

(58) Field of Classification Search ..... 271/234, 271/236, 239, 245, 248, 250, 253, 254, 226
See application file for complete search history.

(56) References Cited

U.S. PATENT DOCUMENTS 8,011,654 B2 * 9/2011 Hayashi ..... 271/221
2007/0296141 A1 * 12/2007 Inoue ..... 271/226

FOREIGN PATENT DOCUMENTS

JP 2010-089867 A 4/2010

* cited by examiner

*Primary Examiner* — Prasad Gokhale
(74) *Attorney, Agent, or Firm* — Fitzpatrick, Cella, Harper & Scinto

(57) ABSTRACT

A control portion controls a skew feed correcting portion so that a first skew feed correcting operation for correcting skew feed of a sheet while turning the sheet based on one edge of the sheet crossing a sheet conveying direction is performed in a case where a first alignment operation based on a position of one edge of the sheet is performed when a sheet processing portion processes the sheet. Further, the control portion controls the skew feed correcting portion so that a second skew feed correcting operation for correcting the skew feed of the sheet based on a side edge of the sheet parallel to the sheet conveying direction is performed in a case where a second alignment operation based on a position of the side edge of the sheet is performed when the sheet processing portion processes the sheet.

5 Claims, 9 Drawing Sheets

| FIG. 4A |
| --- |
| FIG. 4B |

IMAGE FORMING APPARATUS

BACKGROUND OF THE INVENTION

1. Field of the Invention

The present invention relates to an image forming apparatus, and more particularly, to an image forming apparatus for processing a sheet having cutting unevenness by a sheet processing device after forming an image on the sheet.

2. Description of the Related Art

Conventionally, an image forming apparatus such as a copier, a printer, or a facsimile machine includes a sheet conveying device for conveying a sheet to an image forming portion. The sheet conveying device may include a skew feed correcting portion for correcting skew feed of a sheet and displacement thereof in a direction orthogonal to a conveying direction of the sheet (hereinafter, referred to as "width direction") in order to adjust the posture and position of the sheet by the time the sheet is conveyed to the image forming portion.

In recent years, various sheets such as coated paper, embossed paper, super-thick paper, super-thin paper are used in an image forming apparatus. Therefore, there is a demand for an image forming apparatus which is capable of correcting skew feed at high speed with high accuracy so as to handle any kind of sheets to be used, in addition to having high productivity.

In order to achieve high-speed and high-accuracy skew feed correction, there is a technology in which two skew feed correcting roller pairs are provided at a predetermined interval in a direction orthogonal to a sheet conveying direction, and a skew feed detection sensor for detecting skew feed of the leading edge of a sheet is provided on a downstream side of the skew feed correcting roller pairs in the conveying direction. In such a conventional skew feed correcting portion of an active skew feed correction system, first, the skew feed of a sheet is detected based on a detection signal of the skew feed detection sensor.

Then, the skew feed correcting roller pairs that are driven independently are increased or decreased in speed in accordance with the detected skew feed amount of the sheet. Accordingly, the sheet is turned so that the skew feed of the sheet is corrected. The conventional skew feed correcting portion of an active skew feed correction system corrects skew feed by turning a sheet in accordance with the skew feed amount of the sheet without stopping the sheet. This enables high-speed and high-accuracy skew feed correction for the sheet.

Ideally, the shape of a cut sheet to be used by a user is rectangular. However, the cut sheet is often obtained by cutting a sheet with two blades parallel to each other, and hence, in practice, unevenness occurs during cutting. As the cutting unevenness, cutting unevenness in the shape of a parallelogram as illustrated in FIG. 6A often occurs. In addition, there is cutting unevenness in shape as illustrated in FIGS. 6B and 6C.

Even in sheets having the same size, an angle formed by the leading edge of the sheet and the side edge thereof may not be a right angle as illustrated in FIGS. 6A to 6C. In this case, when skew feed is corrected based on a side B of the leading edge of the sheet, image margin amounts on the back side of an apparatus defining lateral registrations become $d_{41}$, $d_{42}$, and $d_{43}$, respectively, as illustrated in FIGS. 6A to 6C. In the case where image margin amounts are varied, the image position on the sheet is not kept constant.

Therefore, for example, in the case of replacing sheets to be used, a user needs to determine a skew feed adjustment amount by outputting a sampling image once and reading a skew feed amount, and to offset the skew feed correction amount by an amount corresponding to the skew feed adjustment amount. FIG. 7A illustrates the behavior of a sheet S and a resultant product after an image is formed thereon in the case of correcting skew feed of the sheet without inputting a skew feed adjustment amount. FIG. 7B illustrates the behavior of a sheet S and a resultant product after an image is formed thereon in the case of correcting skew feed of the sheet by inputting a skew feed adjustment amount. In general, the skew feed amount of a long side of a sheet is read, and the read skew feed amount is offset to adjust a skew feed amount. However, the user may adjust a skew feed amount based on any one of a short side and a long side of a sheet.

Thus, when the position of an image with respect to a sheet is adjusted, one skew feed adjustment amount (skew feed offset amount) is required for each kind of sheets to be used. There is also cutting unevenness caused by lot differences of sheets, and hence the user needs to reconsider the skew feed adjustment amount every time the lot of the sheets to be used is changed.

Conventionally, there is provided a media library capable of storing the adjustment amounts of skew feed amount and image position set by the user for each kind of sheets and for each container such as a cassette in which sheets are to be contained (Japanese Patent Application Laid-Open No. 2010-089867). In the case where a skew feed amount is adjusted, a skew feed adjustment amount of a sheet stored in the media library is added to a skew feed amount detected by a skew feed detection sensor, to thereby determine a skew feed correction amount. Skew feed is corrected based on the determined skew feed correction amount. Thus, image position accuracy for each sheet is guaranteed.

A conventional image forming apparatus may include a sheet processing device for sequentially performing various processes such as cutting, bookbinding, and punching. When processing a sheet, such a sheet processing device performs the respective processes after aligning the sheet based on the leading edge thereof and the side edge thereof parallel to a sheet conveying direction.

For example, in the case where the sheet processing device aligns a sheet based on the leading edge thereof, a sheet S is pressed by an alignment plate 50 as illustrated in FIG. 8A. At this time, in the case where skew feed is corrected based on the side edge of the sheet and then an image is formed on the sheet as illustrated in FIG. 7B, when the sheet S is pressed by the alignment plate as illustrated in FIG. 8A, the sheet S is skewed. Therefore, a resultant product of the processed sheet S is degraded in quality.

If the shape of a sheet side edge with respect to a sheet leading edge is stored in advance, skew feed can be corrected based on the side edge of the sheet instead of the leading edge thereof. However, if such correction is performed, in the case where the sheet processing device aligns the leading edge of a sheet, the sheet is skewed when pressed by the alignment plate 50 as illustrated in FIG. 8B. Therefore, the reference at a time of formation of an image is still different from the reference of the processing of the processing device, and hence a resultant product of the processed sheet is degraded in quality.

Further, in the case where the sheet processing device aligns the short side of a sheet, a resultant product with high accuracy is obtained in the end if an image is formed based on the short side. However, in a conventional image forming apparatus, the reference of image formation cannot be changed between the short side of a sheet and the long side thereof.

SUMMARY OF THE INVENTION

The present invention has been made in view of the above-mentioned circumstances, and an object of the present invention is to provide an image forming apparatus capable of preventing degradation in quality of a product of a processed sheet when the sheet is processed by a sheet processing device.

According to the present invention, there is provided an image forming apparatus which has an image forming portion, a sheet conveying device conveying a sheet to the image forming portion, and a sheet processing device processing the sheet on which an image is formed by the image forming portion, the image forming apparatus including: a skew feed correcting portion which is provided in the sheet conveying device, and which corrects skew feed of the sheet while turning the sheet by at least one of a first skew feed correcting operation for correcting the skew feed based on one edge of the sheet crossing a sheet conveying direction, and a second skew feed correcting operation for correcting the skew feed based on a side edge of the sheet along the sheet conveying direction; a sheet processing portion which is provided in the sheet processing device, and which performs, when processing the sheet, at least one of a first alignment operation based on a position of the one edge of the sheet, and a second alignment operation based on a position of the side edge of the sheet; and a control portion which controls the skew feed correcting portion so that the first skew feed correcting operation is performed in a case where the sheet processing portion performs the first alignment operation, and that the second skew feed correcting operation is performed in a case where the sheet processing portion performs the second alignment operation.

Further features of the present invention will become apparent from the following description of exemplary embodiments with reference to the attached drawings.

DESCRIPTION OF THE EMBODIMENT

Figure 1:
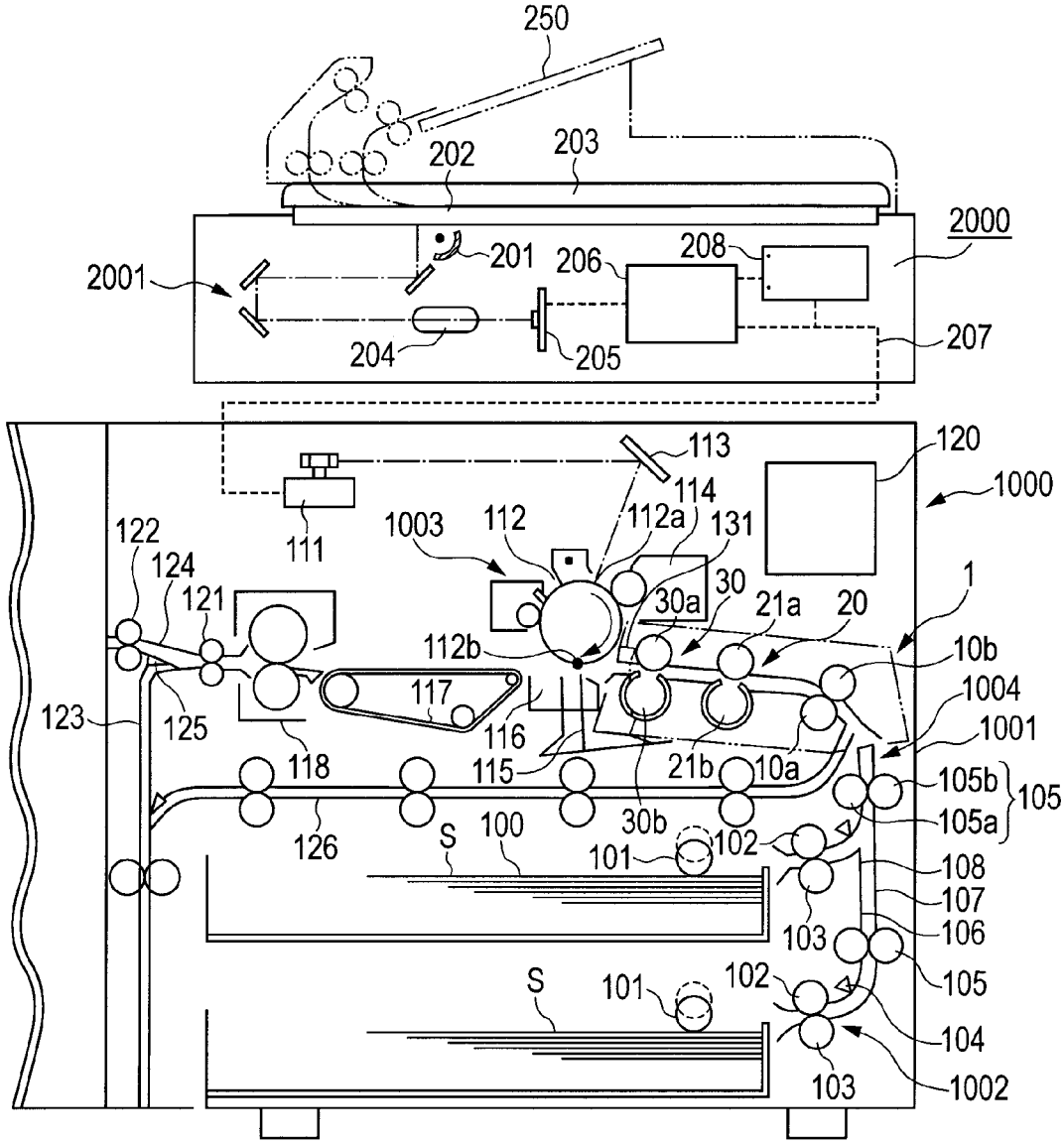
FIG. 1 is a schematic structural view of a printer that is an example of an image forming apparatus according to an embodiment of the present invention.

Hereinafter, an embodiment of the present invention is described in detail with reference to the drawings. FIG. 1 is a schematic structural view of a printer that is an example of an image forming apparatus according to the embodiment of the present invention. In FIG. 1, a printer 1000 includes a printer main body 1001 and a scanner 2000 arranged above an upper surface of the printer main body 1001. Further, a sheet processing device 3000 is connected to the side of the printer main body 1001.

The scanner 2000 for reading an original includes a scanning optical light source 201, a platen glass 202, and an original pressure plate 203 that is openable and closable. The scanner 2000 is also provided with an image reading portion 2001 including a lens 204, a light-receiving element (photoelectric conversion element) 205, an image processing portion 206, and a memory portion 208 for storing an image processing signal processed in the image processing portion 206.

When an original is read, the scanning optical light source 201 irradiates an original (not shown) placed on the platen glass 202 with light. The read original image is processed in the image processing portion 206 and then converted into an electrically encoded electric signal 207 to be transmitted to a laser scanner 111 serving as an image-forming unit. The encoded image information processed in the image processing portion 206 may also be temporarily stored in the memory portion 208 and transmitted to the laser scanner 111, as necessary, in response to a signal from a controller 120.

The printer main body 1001 includes a sheet feeding device 1002, a sheet conveying device 1004 for conveying a sheet S fed by the sheet feeding device 1002 to an image forming portion 1003, and the controller 120 serving as a control unit for controlling the printer 1000. The sheet processing device 3000 for processing the sheet S delivered from the printer main body 1001 is provided on one side of the printer main body 1001.

The sheet feeding device 1002 includes two (multiple) feed cassettes 100, pickup rollers 101, and a separation portion including a feed roller 102 and a retard roller 103. The sheets S in the feed cassette 100 are separated and fed one by one by the functions of the separation portion and the pickup roller 101 that rises/falls and rotates at a predetermined timing.

The sheet conveying device 1004 includes a vertical path roller pair 105 (105*a*, 105*b*), an assist roller pair 10 (10*a*, 10*b*), and a skew feed correcting portion 1 having a skew feed correcting portion 1A and a registration correcting portion 1B described later.

The sheet S fed from the sheet feeding device 1002 is guided to the skew feed correcting portion 1 by the vertical path roller pair 105, after passing through a sheet conveying path 108 configured by guide plates 106, 107 each having a curved upper portion. Then, the sheet S is corrected for skew feed and displacement in a width direction in the skew feed correcting portion 1 and then conveyed to the image forming portion 1003.

The image forming portion 1003 is an electrophotographic type image forming portion, and includes a photosensitive drum 112 serving as an image bearing member, the laser scanner 111 serving as an image-writing unit, a developing unit 114, a transfer charger 115, and a separation charger 116.

When an image is formed, first, laser light from the laser scanner 111 is turned back on the mirror 113, and an exposure position 112*a* on the photosensitive drum 112 that rotates clockwise is irradiated with the laser light. Thus, a latent image is formed on the photosensitive drum 112. The latent image formed on the photosensitive drum 112 is then visualized as a toner image by the developing unit 114.

In FIG. 1, a registration sensor 131 provided on the downstream side of the registration correcting portion 1B detects the sheet S having passed through the registration correcting portion 1B. When the registration sensor 131 detects the sheet S having passed through the registration correcting portion 1B, the controller 120 sends a sheet leading edge signal (drawing point signal) to the laser scanner 111 based on the detection signal, for example, T seconds after the detection. Thus, the irradiation of laser light by the laser scanner 111 is started.

Next, the visualized toner image on the photosensitive drum is then transferred to the sheet S by the transfer charger 115 in a transfer portion 112*b*. The distance from the exposure position (laser light irradiation position) 112*a* of the photosensitive drum 112 to the transfer portion 112*b* is $l_0$.

The sheet S with the toner image transferred thereto is electrostatically separated from the photosensitive drum 112 by the separation charger 116. After that, the sheet S is conveyed to a fixing device 118 by a conveyer belt 117, and the transferred image is permanently fixed to the sheet S by the fixing device 118. Then, the sheet S with the image fixed thereto is allowed to pass through a delivery path 124 by conveyance rollers 121 and then delivered to and stacked on the sheet processing device 3000 by delivery rollers 122.

Figure 3:
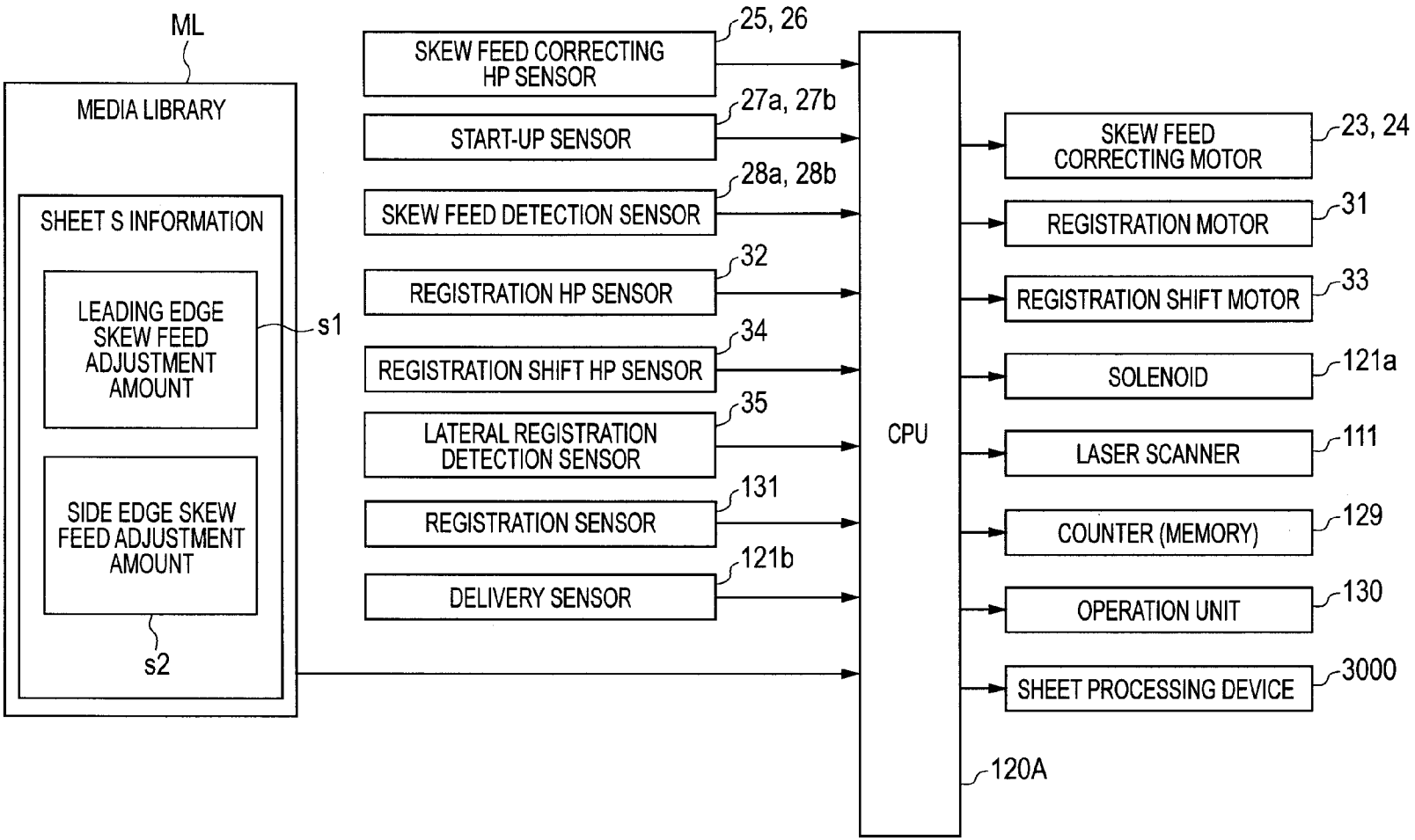
FIG. 3 is a control block diagram of the printer.

In the case of forming an image on both surfaces of a sheet, when a delivery sensor 121*b* illustrated in FIG. 3 detects a sheet with an image formed on one surface thereof, a solenoid 121*a* illustrated in FIG. 3 is operated and a switch member 125 is switched. Thus, the sheet with an image formed on one surface thereof is conveyed to the image forming portion 1003 again through a reverse path 123 and a duplex path 126. An image is formed on the reverse surface of the sheet S on which an image has not been formed. After the image is formed on the reverse surface, the sheet S is delivered to and stacked on the sheet processing device 3000.

The sheet processing device 3000 successively receives sheets delivered from the printer main body 1001, and performs processing of aligning the received multiple sheets and packing the sheets into one bundle, and punching processing of opening a hole in the vicinity of the trailing edges of the received sheets. Further, the sheet processing device 3000 performs stapling processing (binding processing) of stapling the trailing edge side of the sheet bundle and bookbinding processing.

The sheet processing device 3000 includes one or multiple processing portions (not shown) for performing punching processing, stapling processing, and bookbinding processing. The sheet processing device 3000 may perform different alignment operations for various processes with respect to sheets. For example, the sheet processing device 3000 performs a first alignment operation based on the position of the leading edge or the trailing edge of a sheet that is one edge orthogonal to (crossing) a sheet conveying direction, or a second alignment operation based on the position of the side edge of a sheet.

That is, there are cases in which a sheet is aligned through the first alignment operation of aligning a sheet based on the leading edge or the trailing edge of the sheet, and thereafter, the sheet is processed (punching processing, stapling processing, and bookbinding processing), and cases in which a sheet is aligned through the second alignment operation of aligning a sheet based on the side edge of the sheet, and thereafter, the sheet is processed. The alignment operation to be used for aligning a sheet to perform each processing is determined appropriately depending upon the configuration (arrangement of the processing portions, etc.) of the sheet processing device.

Figure 2:
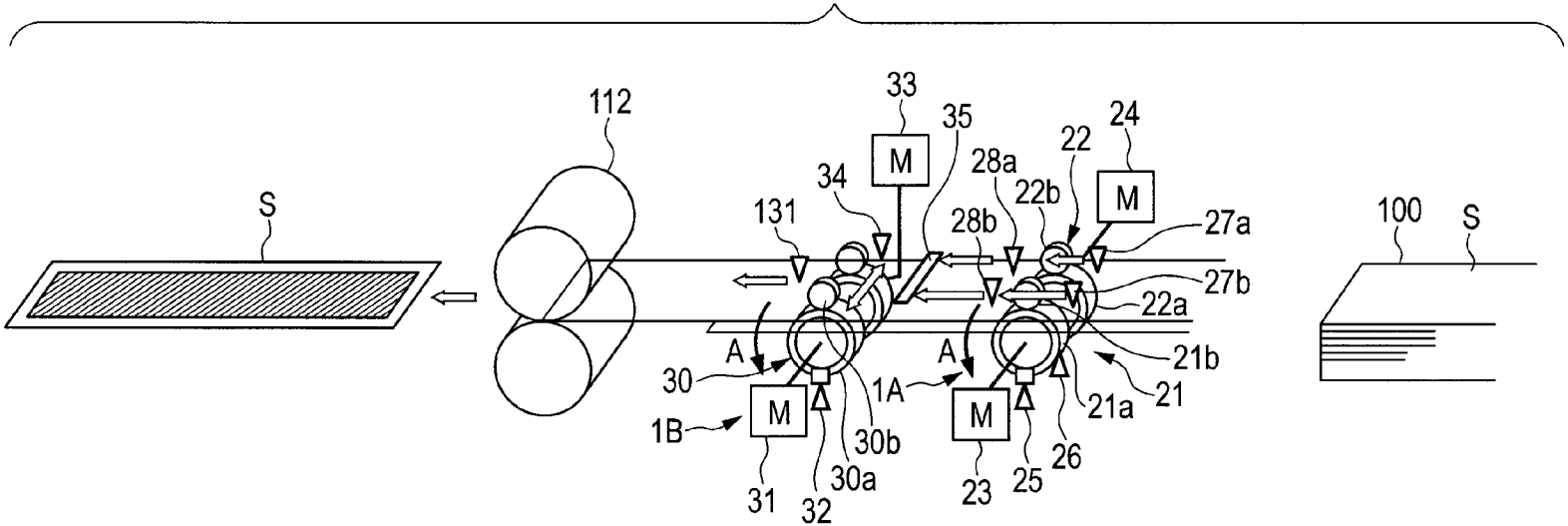
FIG. 2 illustrates a configuration of a skew feed correcting portion provided in a sheet conveying device of the printer.

Next, the skew feed correcting portion 1 is described. The skew feed correcting portion 1 includes the skew feed correcting portion 1A for correcting the skew feed of a sheet and the registration correcting portion 1B for correcting displacement of a sheet in the width direction, as illustrated in FIG. 2. The skew feed correcting portion 1A includes two skew feed correcting roller pairs 21, 22 provided at a predetermined interval in the width direction.

The skew feed correcting roller pairs 21, 22 respectively include drive rollers 21*a*, 22*a* that are drive rotary members each having a cut-away portion on a circumferential surface thereof, and driven rollers 21*b*, 22*b* that are driven rotary members brought into press-contact with the drive rollers 21*a*, 22*a* by pressure springs (not shown). Skew feed correcting motors 23, 24 are coupled to the drive rollers 21*a*, 22*a*, respectively.

On the upstream side of the skew feed correcting roller pairs 21, 22 in the sheet conveying direction, start-up sensors 27*a*, 27*b* are provided at a predetermined interval in the width direction. The start-up sensors 27*a*, 27*b* detect the skew feed amount of a sheet, and start driving the skew feed correcting motors 23, 24 in accordance with the timing at which the start-up sensors 27*a*, 27*b* detect the leading edge of the sheet. The skew feed of the sheet can be corrected by driving the skew feed correcting motors 23, 24 in accordance with the timing at which the start-up sensors 27*a*, 27*b* detect the leading edge of the sheet.

On the downstream side of the skew feed correcting roller pairs 21, 22 in the sheet conveying direction, skew feed detection sensors 28*a*, 28*b* for detecting whether or not the skew feed has been corrected completely by the skew feed correcting roller pairs 21, 22 are provided at a predetermined interval in the width direction. In the case where the skew feed detection sensors 28*a*, 28*b* detect the skew feed of the sheet S, the skew feed correcting roller pairs 21, 22 correct skew feed again.

In this embodiment, the skew feed of a sheet is corrected through leading side deceleration control of decelerating the leading side of the leading edge of the sheet. Further, in this embodiment, a skew feed amount detection portion for detecting the skew feed amount of a sheet is configured together with the start-up sensors 27*a*, 27*b* and the skew feed detection sensors 28*a*, 28*b*.

The registration correcting portion 1B includes a registration roller pair 30 having a registration drive roller 30*a* that is a drive rotary member having a cut-away portion on the circumferential surface thereof, and a registration driven roller 30*b* that is a driven rotary member brought into press-contact with the registration drive roller 30*a* by a pressure spring (not shown). The registration drive roller 30*a* is coupled to a registration motor 31.

The registration roller pair 30 is provided slidably in an axial direction thereof, and is driven by a registration shift motor 33 in the width direction. On the upstream side of the registration roller pair 30 in the sheet conveying direction, there is provided a lateral registration detection sensor 35 serving as a side edge detection portion for detecting the lateral registration position, i.e., the position in the width direction, of the sheet S that is being conveyed.

The registration shift motor 33 is driven in accordance with the lateral registration position (side edge position) detected by the lateral registration detection sensor 35, and accordingly, the registration roller pair 30 slides in the axial direction. Thus, the side edge position of the sheet is corrected. That is, in this embodiment, the registration roller pair 30 serving as a side edge correcting portion moves a sheet in the width direction while conveying the sheet in accordance with the side edge position detected by the lateral registration detection sensor 35, and thus corrects the side edge position of the sheet.

The registration sensor 131 for detecting the leading edge of the sheet S is arranged on the downstream side of the registration roller pair 30. Skew feed correcting HP sensors 25, 26 detect the home position (HP) of the skew feed correcting roller pairs 21, 22. There are also provided a registration HP sensor 32 and a registration shift HP sensor 34.

FIG. 3 is a control block diagram of the printer 1000. A CPU 120A serving as a control portion provided in the controller 120 (see FIG. 1) receives detection signals input from the skew feed correcting HP sensors 25, 26 and the start-up sensors 27*a*, 27*b*. The CPU 120A serving as a control portion also receives detection signals input from the skew feed detection sensors 28*a*, 28*b*, the registration HP sensor 32, the registration shift HP sensor 34, the lateral registration detection sensor 35, the registration sensor 131, and the delivery sensor 121*b*.

The CPU 120A is connected to the skew feed correcting motors 23, 24, the registration motor 31, the registration shift motor 33, the laser scanner 111, a memory 129, an operation unit 130, the solenoid 121*a*, and the sheet processing device 3000. The CPU 120A drives each motor and the sheet processing device 3000 based on a detection signal from each sensor and a copying start signal or printing start signal from the operation unit 130. In this embodiment, the CPU 120A directly drives the sheet processing device 3000. However, the CPU 120A may also drive the sheet processing device 3000 through a control portion (not shown) provided in the sheet processing device 3000.

In FIG. 3, a media library ML serves as a skew feed adjustment amount storage portion for storing sheet information for each feed cassette (sheet container) in order to guarantee the image position accuracy for each sheet in which an angle formed by a leading edge of the sheet and a side edge thereof is not a right angle. In the media library ML, a user inputs and sets, through the operation unit 130 as sheet information, a leading edge skew feed adjustment amount s1 that is an offset amount (adjustment amount) of a skew feed correction amount for adjusting the skew feed of the leading edge of a sheet. In the media library ML, the user also inputs and sets a side edge skew feed adjustment amount s2 that is an offset amount (adjustment amount) of a skew feed correction amount for adjusting the skew feed of a side edge of a sheet along the sheet conveying direction.

The CPU 120A corrects the skew feed of a sheet with a skew feed amount obtained by correcting the skew feed amount detected by the skew feed detection sensors 28*a*, 28*b* through use of the leading edge skew feed adjustment amount s1 or the side edge skew feed adjustment amount s2 stored in the media library ML. For example, in the case of a first skew feed correcting operation of correcting the skew feed of a sheet based on the leading edge that is one edge of the sheet, the skew feed of a sheet is corrected based on the leading edge with the skew feed amount corrected through use of the leading edge skew feed adjustment amount s1 that is a first skew feed adjustment amount.

In the case of a second skew feed correcting operation of correcting the skew feed of a sheet based on the side edge along the sheet conveying direction, the skew feed of a sheet is corrected based on the side edge with the skew feed amount corrected through use of the side edge skew feed adjustment amount s2 that is a second skew feed adjustment amount. Through the correction of the skew feed of a sheet with the skew feed amount corrected through use of the leading edge skew feed adjustment amount s1 or the side edge skew feed adjustment amount s2, the image position can be kept constant at all times even in the case of a sheet in which an angle formed by a leading edge of the sheet and a side edge thereof is not a right angle.

In this embodiment, a skew feed adjustment amount for adjusting the turning amount of a sheet in accordance with the shape of the sheet measured in advance is stored in the media library. When the sheet is turned by the skew feed correcting motors 23, 24 based on the position of the leading edge of the sheet detected by the sensors 27, 28, the turning amount is decreased or increased in accordance with the leading edge skew feed adjustment amount s1 or the side edge skew feed adjustment amount s2. That is, the CPU 120A determines (adjusts) a skew feed correction amount with respect to a sheet in which an angle formed by a leading edge of the sheet and a side edge thereof is not a right angle (hereinafter, referred to as "non-rectangular sheet") based on the leading edge skew feed adjustment amount s1 and the side edge skew feed adjustment amount s2, and operates the skew feed correcting motors 23, 24.

The non-rectangular sheet is corrected for skew feed with the skew feed amount corrected through use of the leading edge skew feed adjustment amount s1 or the side edge skew feed adjustment amount s2, and then conveyed to the image forming portion 1003. In the image forming portion 1003, an image is formed, and then the non-rectangular sheet is conveyed to the sheet processing device 3000. The sheet processing device 3000 may include, for example, a processing portion for processing a sheet after aligning the sheet through the first alignment operation based on the leading edge of the sheet. Alternatively, the sheet processing device 3000 may include a processing portion for processing a sheet after aligning the sheet through the second alignment operation based on the side edge of the sheet. Further, the sheet processing device 3000 may include both the sheet processing portion for performing the first alignment operation and the sheet processing portion for performing the second alignment operation.

Figure 8A:
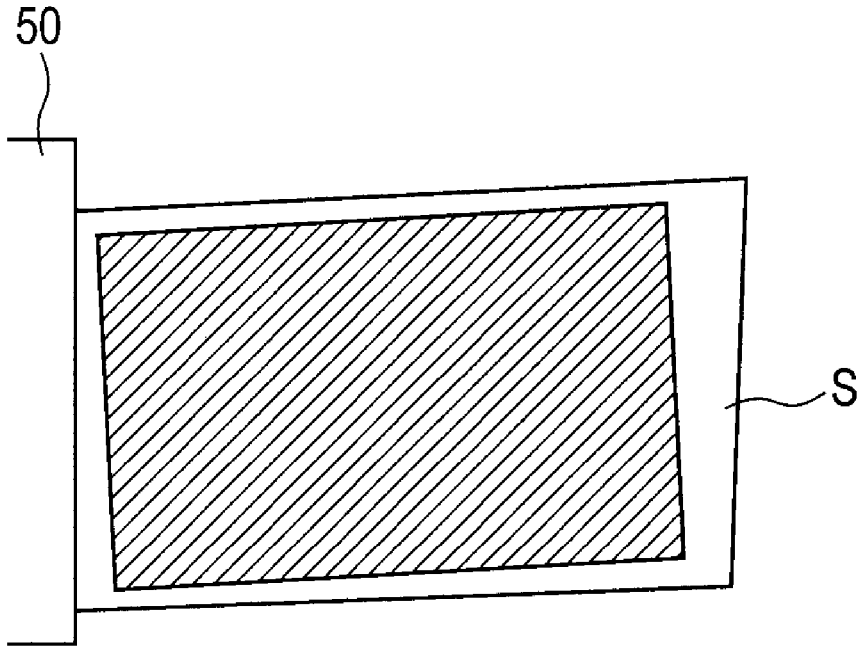
FIGS. 8A and 8B illustrate states of sheets that are being aligned in a conventional sheet processing device.
Figure 8B:
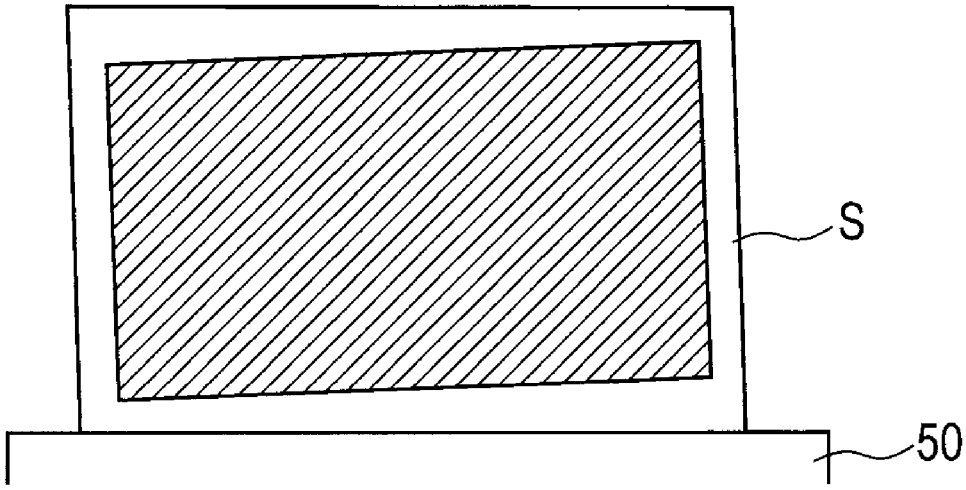

For example, in the case where the sheet processing portion performs the second alignment operation, when a sheet corrected for skew feed based on the leading edge is to be processed, a product with high accuracy cannot be obtained as illustrated in FIG. 8B. In the case where the sheet processing portion performs the first alignment operation, when a sheet corrected for skew feed based on the side edge is to be processed, a product with high accuracy cannot be obtained as illustrated in FIG. 8A.

In this embodiment, when the skew feed of a sheet is corrected, in the case where alignment reference information of the sheet processing portion is first read and all of the one or multiple sheet processing portions process a sheet based on the leading edge, the skew feed correcting portion 1 is controlled so as to perform the first skew feed correcting operation. When the first skew feed correcting operation is performed, a leading edge skew feed adjustment amount is assigned from the media library based on the read alignment reference information. In the case where all of the one or multiple sheet processing portions process a sheet based on the side edge, the skew feed correcting portion 1 is controlled so as to perform the second skew feed correcting operation. When the second skew feed correcting operation is performed, a side edge skew feed adjustment amount is assigned from the media library based on the read alignment reference information.

More specifically, for example, in the case where the sheet processing device 3000 includes one or multiple sheet processing portions, if all the sheet processing portions align a sheet based on the leading edge, a leading edge skew feed adjustment amount is assigned as an adjustment amount for correcting the skew feed of a sheet before formation of an image. If all the multiple sheet processing portions align a sheet based on the side edge, a side edge skew feed adjustment amount is assigned as an adjustment amount for correcting the skew feed of a sheet before formation of an image.

Figures 4, 4A:
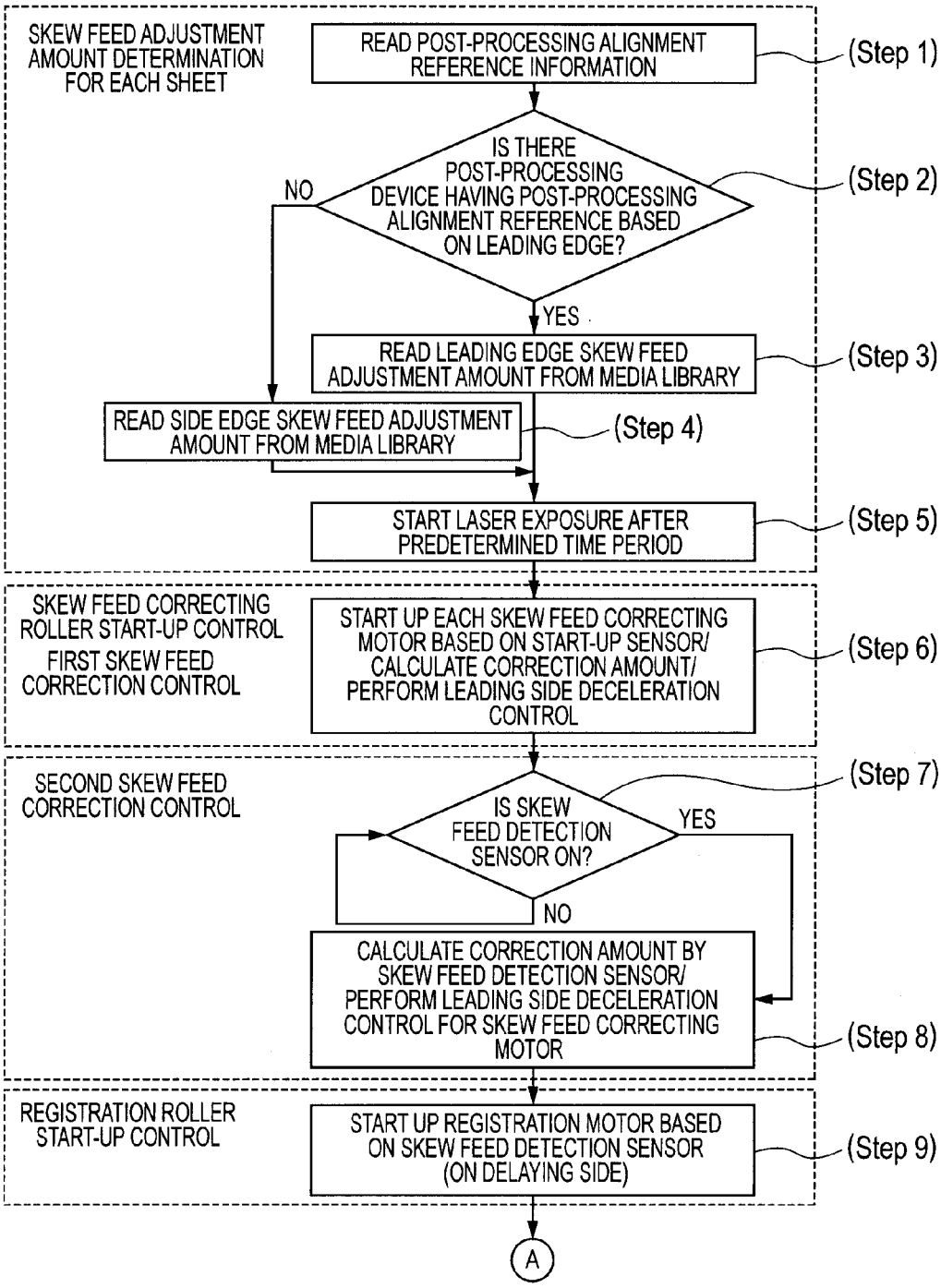
FIG. 4 is comprised of FIGS. 4A and 4B which are flowcharts illustrating skew feed correction and registration correction control operations of the skew feed correcting portion.
Figure 4B:
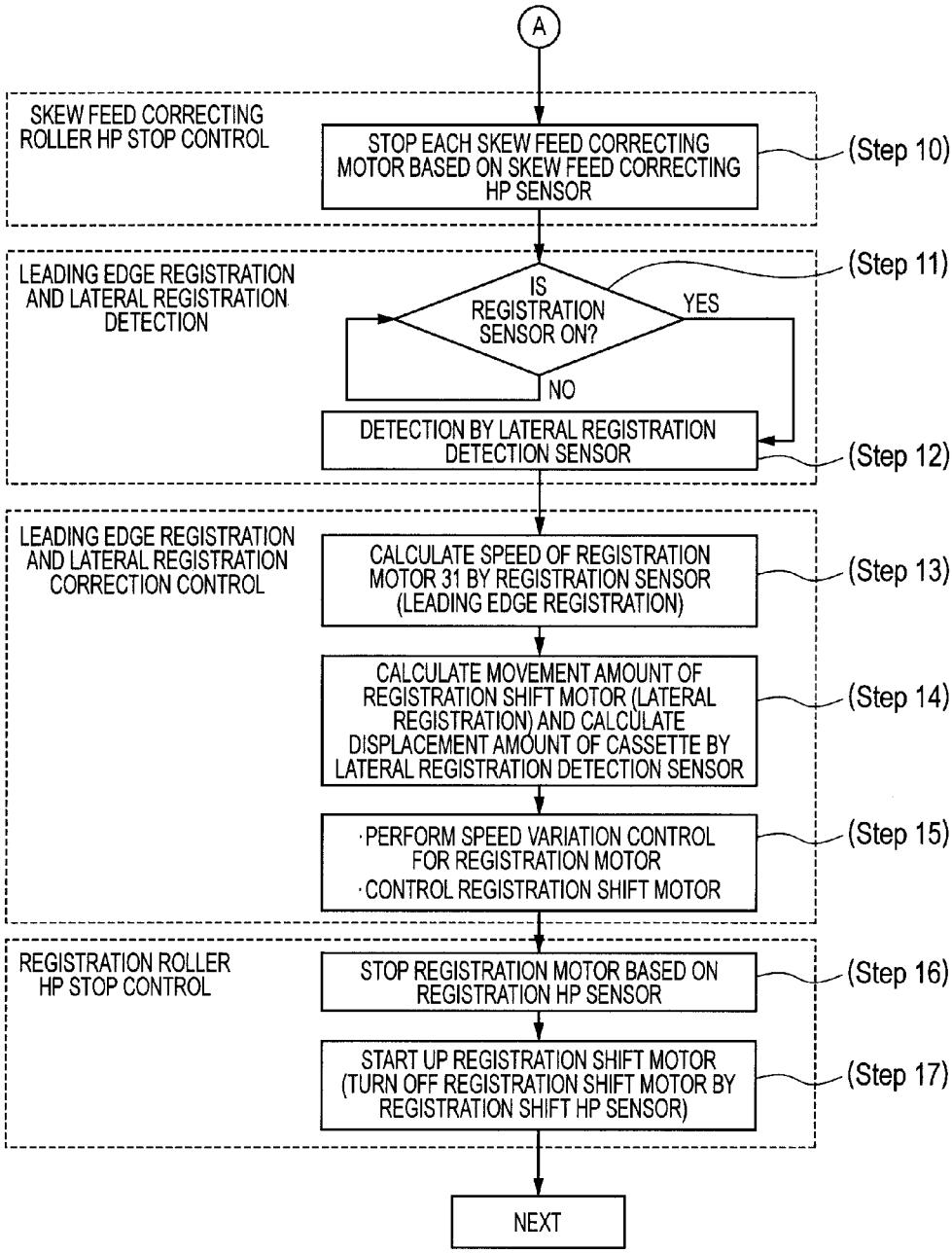

Next, the skew feed correction and registration correction control operations of the CPU 120A (controller 120) according to this embodiment are described with reference to FIGS. 4A and 4B When copying or printing is started, a cassette is selected in accordance with the selected sheet size and basis weight by the CPU 120A. Simultaneously, alignment reference information of all the sheet processing portions is read (Step 1). The CPU 120A determines whether or not there is a sheet processing portion that aligns a sheet through the first alignment operation, that is, aligns a sheet based on the leading edge (Step 2). In the case where there is a sheet processing portion that aligns a sheet based on the leading edge (YES in Step 2), the leading edge skew feed adjustment amount s1 that is alignment reference information set by the user is read from the media library (Step 3).

In the case where there is no sheet processing portion that aligns a sheet based on the leading edge (NO in Step 2), that is, in the case where all the sheet processing portions align a sheet based on the side edge, the side edge skew feed adjustment amount s2 set by the user is read from the media library (Step 4). That is, in the case where all the sheet processing portions align a sheet through the second alignment operation, the side edge skew feed adjustment amount s2 is read.

Laser exposure is started when a predetermined period of time has elapsed after skew feed adjustment amount determination processing is performed for each sheet (Step 5). Next, when the start-up sensors 27*a*, 27*b* detect the leading edge of the sheet S conveyed to the skew feed correcting portion 1, the skew feed correcting motors 23, 24 are started up based on respective detection timings of the start-up sensors 27*a*, 27*b*. Further, the skew feed amount of a sheet leading edge is calculated to obtain a correction amount based on a difference in detection times of the start-up sensors 27*a*, 27*b*. The skew feed correcting roller pairs 21, 22, in which respective roller nip portions have been released, are rotated through the leading side deceleration control based on the obtained correction amount, to thereby perform first skew feed correction (Step 6). At this time, in the case of the first skew feed correcting operation, the turning amount of a sheet is adjusted with the leading edge skew feed adjustment amount read in advance, and in the case of the second skew feed correcting operation, the turning amount of a sheet is adjusted with the side edge skew feed adjustment amount.

Next, after skew feed correcting roller start-up control and first skew feed correction control processes, the CPU 120A waits for the skew feed detection sensors 28*a*, 28*b* to be turned ON (Step 7). When the skew feed detection sensors 28*a*, 28*b* are turned ON (YES in Step 7), the skew feed amount of a sheet leading edge is calculated to obtain a correction amount based on respective detection timings. After that, the skew feed correcting motors 23, 24 are driven to rotate the skew feed correcting roller pairs 21, 22 through the leading side deceleration control based on the obtained correction amount, to thereby perform second skew feed correction (Step 8). That is, in the case where the skew feed is not corrected completely, the skew feed amount of the sheet S is detected by the skew feed detection sensors 28*a*, 28*b* on the downstream side to perform the second skew feed correction. Also at this time, the turning amount of a sheet is adjusted with the skew feed adjustment amount, if required.

After the second skew feed correction control, the registration motor 31 is started up based on the skew feed detection sensor (on delaying side) (Step 9: registration roller start-up control). This rotates the registration roller pair 30, in which a roller nip portion has been released, to convey the sheet S. After that, the sheet S is nipped by the registration roller pair 30. Then, the skew feed correcting motors 23, 24 are each stopped under the state in which the roller nip portions of the skew feed correcting roller pairs 21, 22 have been released, based on the skew feed correcting HP sensor (Step 10: skew feed correcting roller HP stop control).

Next, the CPU 120A waits for the registration sensor 131 to detect a sheet and be turned ON (Step 11). When the registration sensor 131 detects a sheet and is turned ON (YES in Step 11), the lateral registration detection sensor 35 detects the side edge position of the sheet S (Step 12). Then, after the leading edge registration and lateral registration detection processing, the CPU 120A calculates a speed of the registration motor based on the signal from the registration sensor 131 (Step 13).

The registration shift motor 33 is started up in accordance with the lateral registration amount detected by the lateral registration detection sensor 35. After that, the movement amount (lateral registration) and the cassette displacement amount by the registration shift motor 33 are calculated (Step 14).

Next, speed variation control for the registration motor 31 is performed based on a difference in time between the detection timing of the registration sensor 131 and the timing at which the photosensitive drum 112 is irradiated with laser light. Thus, the image position on the photosensitive drum is matched with the image formation position on the sheet S. After that, the registration shift motor 33 is controlled based on the detection signal of the lateral registration detection sensor 35 to match the image position on the photosensitive drum 112 with the lateral registration position of the sheet S (Step 15).

After the leading edge registration and lateral registration correction control, when the sheet S is conveyed to the transfer portion by the registration roller pair 30, the registration motor 31 is stopped under the state in which the roller nip portion of the registration roller pair 30 has been released, based on the registration HP sensor 32 (Step S16). Simultaneously with this, the registration shift motor 33 is started up, and the registration roller pair 30 is shifted in a direction opposite to the correction direction. When the registration shift HP sensor 34 is turned OFF, the registration shift motor 33 is stopped (Step 17). After the registration roller HP stop control, the sheet S corrected for position with high accuracy with respect to the image on the photosensitive drum 112 is conveyed to the fixing device 118 and then delivered to the sheet processing device 3000.

Figure 5A:
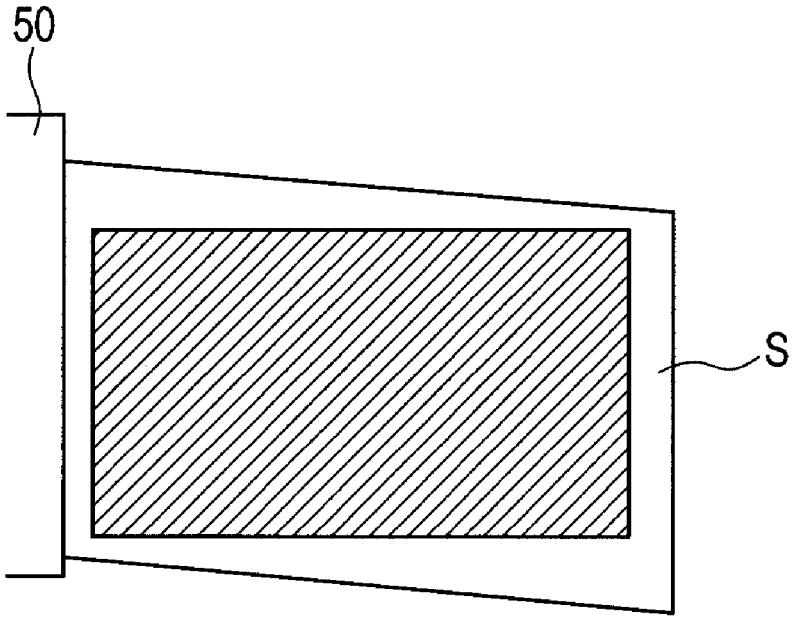
FIGS. 5A and 5B illustrate states of sheets that are being aligned in a sheet processing device provided in the printer.

After that, processes such as punching processing, stapling processing, and bookbinding processing are performed by the one or multiple sheet processing portions provided in the sheet processing device 3000. When a sheet is processed, in the case where there is a sheet processing portion that processes a sheet based on the leading edge, the skew feed correcting portion 1 has performed the first skew feed correcting operation. Thus, as illustrated in FIG. 5A, in the case where the sheet S is aligned based on the leading edge, the image on the sheet S becomes parallel to an alignment plate 50, and hence the degradation in quality of a resultant product of the processed sheet S can be prevented.

Figure 5B:
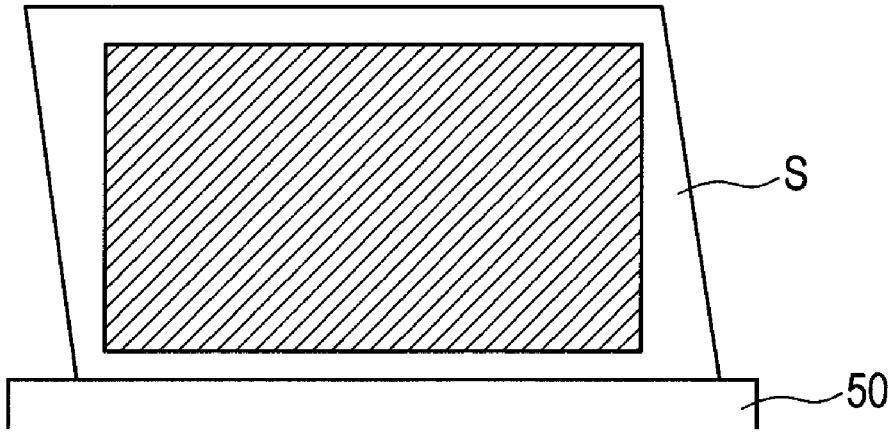
Figure 6A:
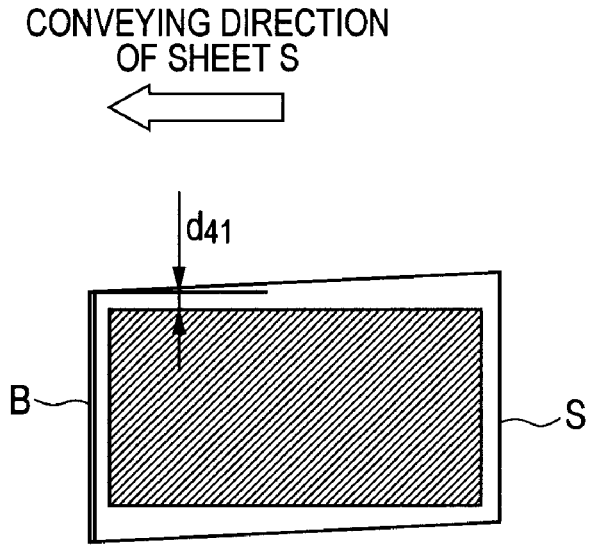
FIGS. 6A, 6B and 6C illustrate a configuration of a conventional skew feed correcting portion of an active skew feed correction system.
Figure 6B:
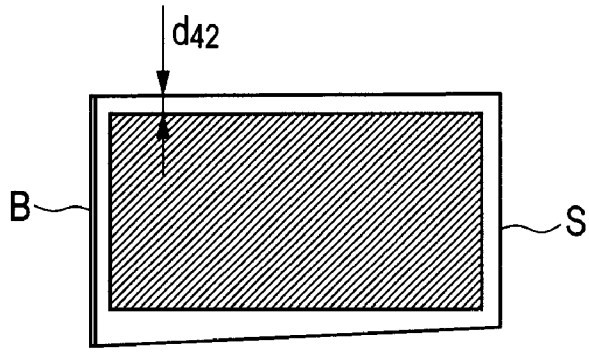
Figure 6C:
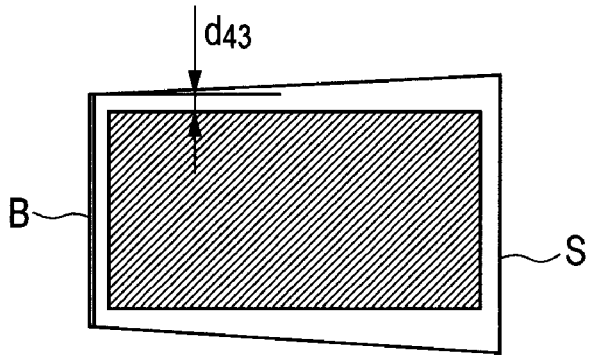
Figure 7A:
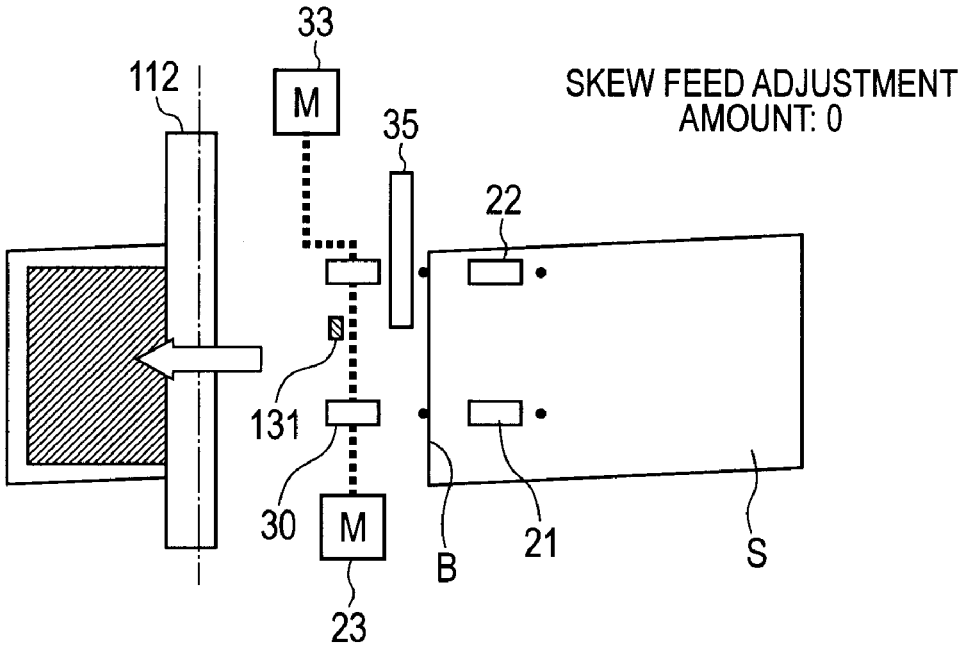
FIGS. 7A and 7B illustrate a difference in an image margin amount caused by the shapes of conventional sheets.
Figure 7B:
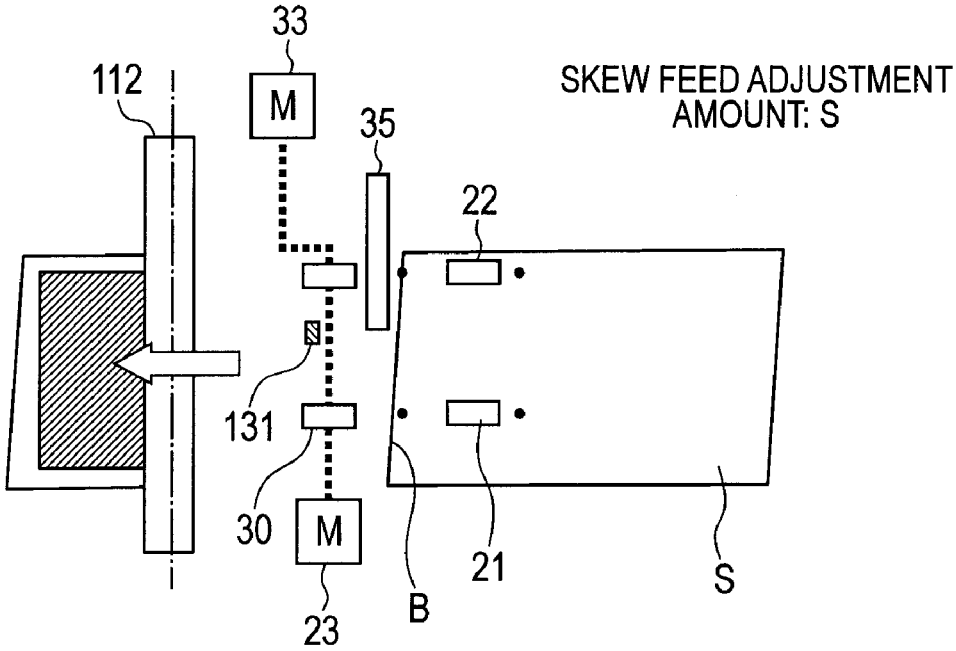

When a sheet is processed, in the case where all the sheet processing portions process a sheet based on the side edge, the skew feed correcting portion 1 has performed the second skew feed correcting operation. Thus, as illustrated in FIG. 5B, in the case where a sheet is aligned based on the side edge, the image on the sheet S becomes parallel to the alignment plate 50, and hence the degradation in quality of a resultant product of the processed sheet S can be prevented.

As described above, in this embodiment, when a sheet is processed, in the case where there is a sheet processing portion that processes a sheet based on the leading edge, the skew feed correcting portion 1 is controlled so as to perform the first skew feed correcting operation. In the case where there is a sheet processing portion that processes a sheet based on the side edge, the skew feed correcting portion 1 is controlled so as to perform the second skew feed correcting operation. Further, the alignment reference of the sheet processing portion is matched with the skew feed correction reference of the skew feed correcting portion. Accordingly, the degradation in quality of a resultant product of a processed sheet can be prevented when the sheet is processed by the sheet processing device 3000.

Note that, in this embodiment, in the case where there are sheet processing portions having different alignment references, a skew feed adjustment amount based on the leading edge is assigned. However, an average value of the leading edge skew feed adjustment amount and the side edge skew feed adjustment amount may be assigned, or a skew feed adjustment amount may be set to be 0. Further, the user may preset which of the leading edge reference or the side edge reference is to be used, and a skew feed adjustment amount may be assigned based on the setting.

An active registration system in which the start-up sensors 27*a*, 27*b* are arranged in the main scanning direction has been described as an example. However, the system is not limited thereto as long as a configuration in which the same effects are obtained is used. For example, the start-up sensors 27*a*, 27*b* may be substituted with the lateral registration detection sensor 35.

Further, in the above description, the relationship between the sheet conveying direction and the sheet shape has been described. However, the same process may be performed for a relationship among an image formed by the image forming apparatus, a conveying direction, and a sheet shape. In the case where the rotation shaft of the photosensitive drum 112 is not parallel to the straight line connecting the skew feed detection sensors 28, when a rectangular image is formed on a sheet, one side of the rectangular image orthogonal to the conveying direction, which is formed after the skew feed is corrected based on the sheet leading edge, is not parallel to the leading edge of the sheet.

In order to correct the above-mentioned defect, a sheet with a rectangular image formed thereon is output in advance from the image forming apparatus, and one side of the rectangular image crossing the conveying direction and the position (angle) of the sheet leading edge are stored in advance in the media library as a leading edge skew feed adjustment amount. Further, when the sheet is turned by the skew feed correcting motors 23, 24 based on the start-up sensor 27 and the skew feed detection sensor 28, the turning amount is decreased or increased by an amount corresponding to the angle of the leading edge skew feed adjustment amount. Accordingly, the image is corrected for skew feed based on the sheet leading edge.

In addition, the shape of the sheet is measured in advance, and the position (angle) of the sheet side edge with respect to the sheet leading edge is stored in advance in the media library as a side edge skew feed adjustment amount. Further, the turning amount of skew feed correction is increased or decreased by an amount corresponding to the side edge skew feed adjustment amount. Accordingly, the image can also be corrected for skew feed based on the sheet side edge.

Although the side edge skew feed adjustment amount is set to be the angle of the sheet side edge with respect to the sheet leading edge, the side edge skew feed adjustment amount may be an angle formed by one side of the rectangular image orthogonal to the conveying direction and the sheet side edge. In this case, through calculation of an angle formed by the sheet leading edge and the sheet side edge based on the side edge skew feed adjustment amount and the leading edge skew feed adjustment amount, skew feed correction can be performed so that the sheet side edge and the image become parallel to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-95656, filed Apr. 22, 2011, which is hereby incorporated by reference herein in its entirety.

What is claimed is:

1. An image forming apparatus which has an image forming portion, a sheet conveying device conveying a sheet to the image forming portion, and a sheet processing device processing the sheet on which an image is formed by the image forming portion, the image forming apparatus comprising:

a skew feed correcting portion which is provided in the sheet conveying device, and which corrects skew feed of the sheet while turning the sheet by at least one of a first skew feed correcting operation for correcting the skew feed based on one edge of the sheet crossing a sheet conveying direction, and a second skew feed correcting operation for correcting the skew feed based on a side edge of the sheet along the sheet conveying direction;

a sheet processing portion which is provided in the sheet processing device, and which performs, when processing the sheet, at least one of a first alignment operation based on a position of the one edge of the sheet, and a second alignment operation based on a position of the side edge of the sheet; and a control portion which controls the skew feed correcting portion so that the first skew feed correcting operation is performed in a case where the sheet processing portion performs the first alignment operation, and that the second skew feed correcting operation is performed in a case where the sheet processing portion performs the second alignment operation.

2. An image forming apparatus according to claim 1, wherein, when the sheet has a shape in which an angle formed by the one edge of the sheet and the side edge of the sheet is not a right angle, the control portion adjusts a turning amount of the sheet at a time of the first skew feed correcting operation and the second skew feed correcting operation in accordance with the shape of the sheet.

3. An image forming apparatus according to claim 2, further comprising a skew feed adjustment amount storage portion which stores a first skew feed adjustment amount for adjusting the turning amount of the sheet at a time of the first skew feed correcting operation in accordance with the shape of the sheet, and a second skew feed adjustment amount for adjusting the turning amount of the sheet at a time of the second skew feed correcting operation in accordance with the shape of the sheet, wherein the control portion adjusts the turning amount of the sheet based on the first skew feed adjustment amount or the second skew feed adjustment amount which is stored in the skew feed adjustment amount storage portion.

4. An image forming apparatus according to claim 3, wherein a plurality of sheet processing portions is provided in the sheet processing device, and in a case where the plurality of sheet processing portions performs different alignment operations, the turning amount of the sheet is adjusted based on one of the first skew feed adjustment amount and the second skew feed adjustment amount.

5. An image forming apparatus according to claim 3, wherein a plurality of sheet processing portions is provided in the sheet processing device, and in a case where the plurality of sheet processing portions performs different alignment operations, the turning amount of the sheet is adjusted based on an average value of the first skew feed adjustment amount and the second skew feed adjustment amount.

* * * * *